US006406571B1

(12) United States Patent
Gupta et al.

(10) Patent No.: US 6,406,571 B1
(45) Date of Patent: Jun. 18, 2002

(54) HEAT TREATMENT OF FORMED ALUMINUM ALLOY PRODUCTS

(75) Inventors: Alok Kumar Gupta, Kingston; David James Lloyd, Bath; Pierre Henri Marois, Kingston, all of (CA)

(73) Assignee: Alcan International Limited, Montreal (CA)

( * ) Notice: Subject to any disclaimer, the term of this patent is extended or adjusted under 35 U.S.C. 154(b) by 0 days.

(21) Appl. No.: 09/568,411

(22) Filed: May 11, 2000

Related U.S. Application Data

(60) Provisional application No. 60/134,372, filed on May 14, 1999.

(51) Int. Cl.[7] ..... C22F 1/04

(52) U.S. Cl. ..... 148/697; 148/700; 148/702; 427/318; 427/327

(58) Field of Search ..... 148/693, 694, 148/699, 700, 702, 697; 427/318, 327; C22F 1/05

(56) References Cited

U.S. PATENT DOCUMENTS 4,897,124 A * 1/1990 Matsuo et al. ..... 148/2
5,616,189 A 4/1997 Jin et al. ..... 148/549
5,672,390 A * 9/1997 Crews, IV et al. ..... 427/307
5,728,241 A 3/1998 Gupta et al. ..... 148/694

* cited by examiner

*Primary Examiner*—George Wyszomierski
*Assistant Examiner*—Janelle Combs Morillo
(74) *Attorney, Agent, or Firm*—Cooper & Dunham LLP

(57) ABSTRACT

A process of producing a shaped article suitable for use as an automotive body panel intended for finishing by painting and, if necessary, baking. The process comprises obtaining a sheet article made of an aluminum alloy of the 2000 or 6000 series in a T4 or T4P temper and that exhibits an increase in hardness after painting and optionally baking, shaping the sheet article by forming to produce an intermediate shaped article, and subjecting the intermediate shaped article to a thermal spiking treatment prior to painting and optionally baking. The thermal spiking treatment involves heating the intermediate shaped article from ambient temperature to a temperature in a range of 150 to 300° C. with or without holding at that temperature for a period of time to enhance the increase in hardness. The process may also include the painting and optionally baking step. The invention includes the shaped articles, either prior to or after painting and optionally baking, produced by the process. The invention makes it possible to provide shaped articles that develop good hardness when used as automotive panels and the like, and may thus make it possible to reduce the gauge (and therefore weight) of those articles. This can be done without having to modify conventional procedures of casting and rolling to gauge to produce coiled sheet products.

13 Claims, 3 Drawing Sheets

HEAT TREATMENT OF FORMED ALUMINUM ALLOY PRODUCTS

CROSS-REFERENCE TO RELATED APPLICATION

This application claims the priority right of our U.S. Provisional patent application Serial No. 60/134,372, filed May 14, 1999.

BACKGROUND OF THE INVENTION

I. Field of the Invention

This invention relates to a heat treatment process for shaped articles, particularly those suitable for use in the fabrication of automotive body panels. More particularly, the invention relates to such articles made from aluminum alloy sheet material that exhibits an improvement of hardness after painting and baking operations have been carried out.

II. Description of the Prior Art

Aluminum alloy sheet is being used more extensively nowadays as a structural and closure sheet material for vehicle bodies as automobile manufacturers strive for improved fuel economy by reducing vehicle weight. Traditionally, aluminum alloy is either direct chill cast to form ingots or continuous cast in the form of a thick strip material, and then hot rolled to a preliminary thickness. In a separate operation, the strip is cold rolled to the final thickness and wound into coil. The coil must then undergo solution heat treatment to allow strengthening of the formed panel during painting and baking (steps usually carried out on shaped automotive parts by vehicle manufacturers or others—also referred to as the paint bake or paint cure).

Several aluminum alloys of the AA (Aluminum Association) 2000 and 6000 series are usually considered for automotive panel applications. The AA6000 series alloys contain magnesium and silicon, both with and without copper but, depending upon the Cu content, may be classified as AA2000 series alloys. These alloys are formable in the T4 or T4P temper conditions and become stronger after painting and baking. Good increases in strength after painting and baking are highly desirable so that thinner and therefore lighter panels may be employed.

It is highly desirable that the alloy sheet, when delivered to the manufacturer, be relatively easily deformable so that it can be stamped or formed into products of the required shapes without difficulty and without excessive springback. However, it is also desirable that the products, once formed and subjected to the normal painting and baking procedure, be relatively hard so that thin sheet can be employed and still provide good dent resistance.

To facilitate understanding, a brief explanation of the terminology used to describe alloy tempers may be in order at this stage. The temper referred to as T4 is well known (see, for example, Aluminum Standards and Data (1984), page 11, published by The Aluminum Association) and refers to alloy produced in the conventional manner, i.e. without intermediate batch annealing and pre-aging. This is the temper in which automotive sheet panels are normally delivered to parts manufacturers for forming into skin panels and the like. Material that has undergone an intermediate batch annealing, but no pre-aging, is said to have a T4A temper. An alloy that has only been solution heat-treated and artificially aged to peak strength is said to be in the T6 temper. Material that has undergone pre-aging but not intermediate batch annealing is said to have a T4P temper, and material that has undergone both intermediate annealing and pre-aging is said to have a T4PA temper. T8 temper designates an alloy that has been solution heat-treated, cold worked and then artificially aged. Artificial aging involves holding the alloy at elevated temperature(s) over a period of time. T8X temper refers to a T8 temper material that has been deformed in tension by 2% followed by a 30 minute treatment at 177° C. to represent the forming plus paint baking treatment typically experienced by formed automotive panels.

An objective has been to provide a good "paint bake response", i.e. a significant difference in hardness between the T4/T4P temper and the final T8X temper.

In the past, attention has been directed to steps carried out on the alloy sheets before the step of shaping the alloy sheets into products. For example, in U.S. Pat. No. 5,728,241 issued on Mar. 17, 1998 to Gupta et al., assigned to Alcan International Limited, a process of producing aluminum sheet of the 6000 series is described having T4 and T8X tempers that are desirable for the production of automotive parts. The aluminum alloy sheet material is subjected before shaping to solution heat treatment and quenching and then, before substantial age hardening has taken place, the sheet material is subjected to one or more heat treatments involving heating the material to a peak temperature in the range of 100 to 300° C., holding the peak temperature for a period of time of less than one minute and then cooling the sheet material.

Similarly, in U.S. Pat. No. 5,616,189 issued on Apr. 1, 1997 to Jin et al., assigned to Alcan International Limited, a process is disclosed that involves subjecting a sheet product, after cold rolling, to a solutionizing treatment (heating to 500 to 570° C.) followed by a quenching or cooling process involving carefully controlled cooling steps to bring about a degree of "pre-aging." This procedure results in the formation of fine stable precipitate clusters that promote a fine, well dispersed precipitate structure during the paint/bake procedure to which automotive panels are subjected, and consequently a relatively high T8X temper.

While such approaches have met with success, they require modification of the traditional process for forming aluminum alloy sheet in strip form. This is inconvenient and may require expensive modification of existing fabrication equipment. Moreover, the disclosed processes involve rather careful temperature control that can be difficult or expensive to achieve.

It would be more convenient to be able to treat products made of aluminum alloy sheet at in some way after they have been formed into desired shapes. This is convenient because such products must anyway be handled and prepared for painting and baking, so additional steps at this point are easily arranged.

SUMMARY OF THE INVENTION

An object of the invention is to provide a process of producing a shaped article of enhanced hardness response without modification of a conventional procedure for produced aluminum sheet material in T4 or T4P temper.

Another object of the present invention is to provide a solution heat treated aluminum alloy product that exhibits a good hardness response during shaped article formation and finishing.

Yet another object of the invention is to produce a formed product from an aluminum alloy sheet material that has a low yield strength in T4 temper and a high yield strength in T8X temper.

According to one aspect of the invention, there is provided a process of producing a painted shaped article, comprising: obtaining a sheet article made of an aluminum alloy of the 2000 or 6000 series in a T4 or T4P temper; shaping the article to form a shaped article; subjecting the shaped article to a thermal spiking treatment involving heating the shaped article temporarily to a peak temperature in a range of 150 to 300° C.; applying paint to the article to form a painted shaped article; and, if necessary to further enhance hardness of the painted shaped article and/or to cure the applied paint, baking the article at a temperature of at least about 177° C.

The term "thermal spike treatment" means a step in which the article is quickly raised in temperature from ambient (or other temperature at which the sheet material may be heated on the part treatment line) to a predetermined maximum temperature and is then quickly cooled or allowed to cool with or without providing a holding period at the peak temperature.

The term "shaped article" includes any article obtained from sheet material for use in fabricating an article or component. The term may include a flat article simply cut from the sheet material, but often refers to a non-planar article produced by a bending or stamping step, e.g. for the production of an automobile fender or door. The term does not include unformed or uncut sheet material of indefinite length, e.g. coiled sheet produced directly from ingots or cast strip.

The present invention may be carried out with any precipitation hardening aluminum alloy of the AA2000 or AA6000 series, i.e. alloys containing Al—Mg—Si or Al—Mg—Si—Cu that are capable of exhibiting an age hardening response.

The invention also relates to a painted and shaped sheet article produced by the above process.

While it has been usual in the past to refer to the desired increase in hardness as the "paint bake response", this term is becoming somewhat less appropriate as fabrication procedures advance. What is important is that this increase in hardness (the hardness response) occur between the shaping step (cutting/forming/stamping) initially carried out on the sheet form of the shaped product, and the finishing of the shaped product for delivery to the automobile manufacturer or the like.

In modern processes, there may not be a traditional paint bake step as paints of lower setting temperature may be employed. In the present application, the term "hardness response" will consequently be used instead of the more conventional term "paint bake response." This term refers to the change in tensile properties of the material at the end of a finishing process involving painting and optionally baking, compared to the properties prior to shaping. In the present invention, this increase may occur partially or fully during painting and baking, or partially or fully before such painting and baking, i.e. during the heat spike treatment itself, as will be explained more fully below.

The advantages of the invention, at least in preferred forms, include the following:

(1) The thermally spiked sheet material parts (e.g. automotive panels) acquire higher strength than those panels which have not been thermally spiked.

(2) In some forms of the invention, the maximum hardness response in the formed part can be obtained through a thermal spiking alone without relying on the paint cure process (or without providing a paint cure at all).

(3) The thermal spiking process, at least in some forms of the invention, can be performed on a continuous basis in ovens typically used for paint cure processes. The process therefore may be integrated seamlessly into the conventional shaping and finishing processes of parts formation, thus leading to convenience, efficiency and economy.

(4) The process provides an alternative possibility to acquire strengths higher than those obtained from the T4P material.

DETAILED DESCRIPTION OF THE PREFERRED EMBODIMENTS

Figure 1:
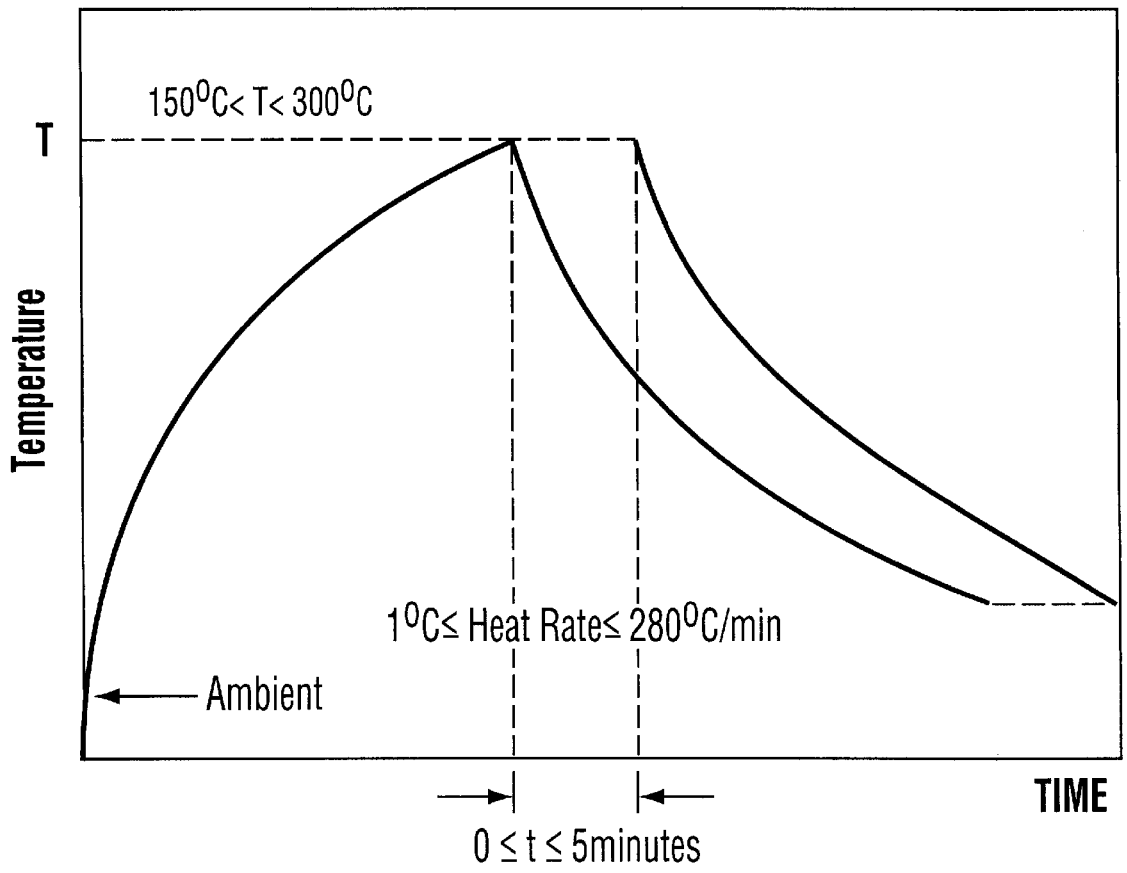
FIG. 1 is graph illustrating a typical thermal spike treatment in accordance with the invention.

According to the present invention, at least in its preferred forms, in order to improve the hardness response of AA2000 or AA6000 series automotive alloy sheet in the T4/T4P temper, an article created from the sheet is subjected to a thermal spike treatment at a temperature in the range of 150–300° C. after shaping (e.g. cutting/forming/stamping). The treatment may either involve a thermal spike confined to the lower part of the temperature range (e.g. 150–225° C.), which then relies on hardening from a subsequent paint bake step, or may involve a thermal spike into the upper part of the temperature range (e.g. 225–300° C.), which does not require additional hardening from a paint bake step (baking to the conventional temperature range may then be avoided, if desired, although conventional painting and baking is not harmful). This latter form of the invention is of special interest because, in the future as new paints are developed, paint bake temperatures are expected to fall below 160° C., a temperature at which hardening effects occur too slowly to fully strengthen the shaped product during normal curing times.

Conventional 6XXX materials in T4 or T4P tempers contain large number of fine metastable clusters and zones uniformly distributed throughout a metal matrix. In the conventional process, during the paint cure, some fine unstable clusters/zones re-dissolve in the metal matrix, while other improve the material strength due to age hardening. The process of the present invention allows the alloy material to exhibit an enhanced aging response (hardness response), although the exact mechanism is not clear. Without wishing to be bound to a particular theory, it is believed that thermal spiking between 150 and 225° C. dissolves some of the clusters and zones and increases the solute super-saturation of the matrix of the formed part. Consequently, the formed part softens slightly, but the hardness response during subsequent painting and baking is improved in comparison with the conventional material. It should be noted that the formed part does not soften when the thermal spiking treatment is carried out at higher spiking temperatures. This is largely due to the fact that the enhanced aging process masks the softening caused by the cluster dissolution. Surprisingly, the dislocations produced during part forming do not interfere with the precipitation process as normally expected. This observation allows the thermally spiked panels to acquire the desired enhanced strength during the paint cure.

To achieve the desired hardness response, thermal spiking to temperatures in the lower part of the range (e.g. 150 to 225° C.) may be carried out at relatively slow heating rates (e.g. about 1 to 70° C./minute), especially if the article is not held at the peak temperature for any time and is merely allowed to cool (or is forcefully cooled) as soon as the peak temperature is achieved. The relatively slow heating rate is often found to be necessary to improve the subsequent paint bake response; i.e. the desired improvement in hardness will often not materialize if the heating rate is any higher. As a consequence, the heating to the peak temperature in this form of the invention may take too long for the step to be incorporated into a continuous stamping and painting line. A batch treatment is therefore required.

If the thermal spiking extends into the upper temperature region (e.g. above 225° C.), the heating rate may be quite rapid (e.g. 10 to 280° C./minute), even if there is essentially no holding time at the peak temperature. It is found that the desired increase in hardness will occur whether the heating rate is in the lower part or the higher part of the range indicated above, but for the process to be incorporated into a continuous stamping and painting/baking line, the peak metal temperature (PMT) must generally be reached within about one minute. If the lowest ambient temperature likely to be encountered is 15° C., the effective range for a continuous operation would likely be 210 to 285° C./minute, which is the preferred heating rate for the high temperature thermal spiking treatment.

The period of time for which the temperature is maintained at the peak thermal spike temperature may range from zero to any time that is practical in the circumstances. From the metallurgical point of view, the longer the time at which the temperature is maintained, the better it is for achieving a desirable hardness response. In practice the period is usually from zero up to about 5 minutes.

FIG. 1 is a graphic representation of a preferred thermal spiking step showing the preferred PMT range, the overall heating rate range and the preferred time range at PMT.

The invention is illustrated by the following Examples, which are not intended to be limiting.

EXAMPLE 1

The invention was tested using a commercially produced AA6111 material.

DC ingot 600×1600 mm double length of the AA6111 alloy containing 0.72% Cu, 0.7% Mg, 0.6% Si, 0.25% Fe, 0.20% Mn and 0.06% Cr was cast on a commercial scale. The ingots were scalped 12.5 mm per rolling face, fully homogenized, hot rolled and cold rolled to the final 0.93 mm gauge, fully solutionized, rapidly cooled, naturally aged for ≧48 hours and sampled for laboratory evaluation.

The paint bake response of the material was evaluated after subjecting it to a heat treatment according to the invention. Tensile samples were pre-strained by different amounts to simulate a typical forming operation, thermally spiked in a sand bed furnace at 240° C. and aged for 30 minutes at 177° C. The results are summarized in Table 1 below.

TABLE 1

Tensile Properties of the Samples, with and without Uni-Axial Pre-Strains, Thermally Spiked at 240° C. in a Laboratory Furnace

| | YS @ (%) Pre-Strain | | Tensile Properties After Simulated Paint Cure (½ h @ 177° C.) | | | | | | |
|---|---|---|---|---|---|---|---|---|---|
| | | Inventive, After | Conventional Material | | | Inventive Material | | | % Increase in YS from |
| Pre-Strain (%) | Conventional | Spiking at 240° C. | YS (MPa) | UTS (MPa) | % El | YS (MPa) | UTS (MPa) | % El | Conventional Material |
| 0 | 145 | 103 | 176 | 299 | 24.2 | 200 | 312 | 21.3 | 13.6 |
| 2 | 189 | 151 | 219 | 306 | 22.2 | 250 | 324 | 19.2 | 14.2 |
| 5 | 228 | 189 | 253 | 318 | 19.9 | 281 | 334 | 16.8 | 11.0 |
| 10 | 265 | 222 | 287 | 334 | 17.5 | 302 | 342 | 15.4 | 5.2 |

Figure 2:
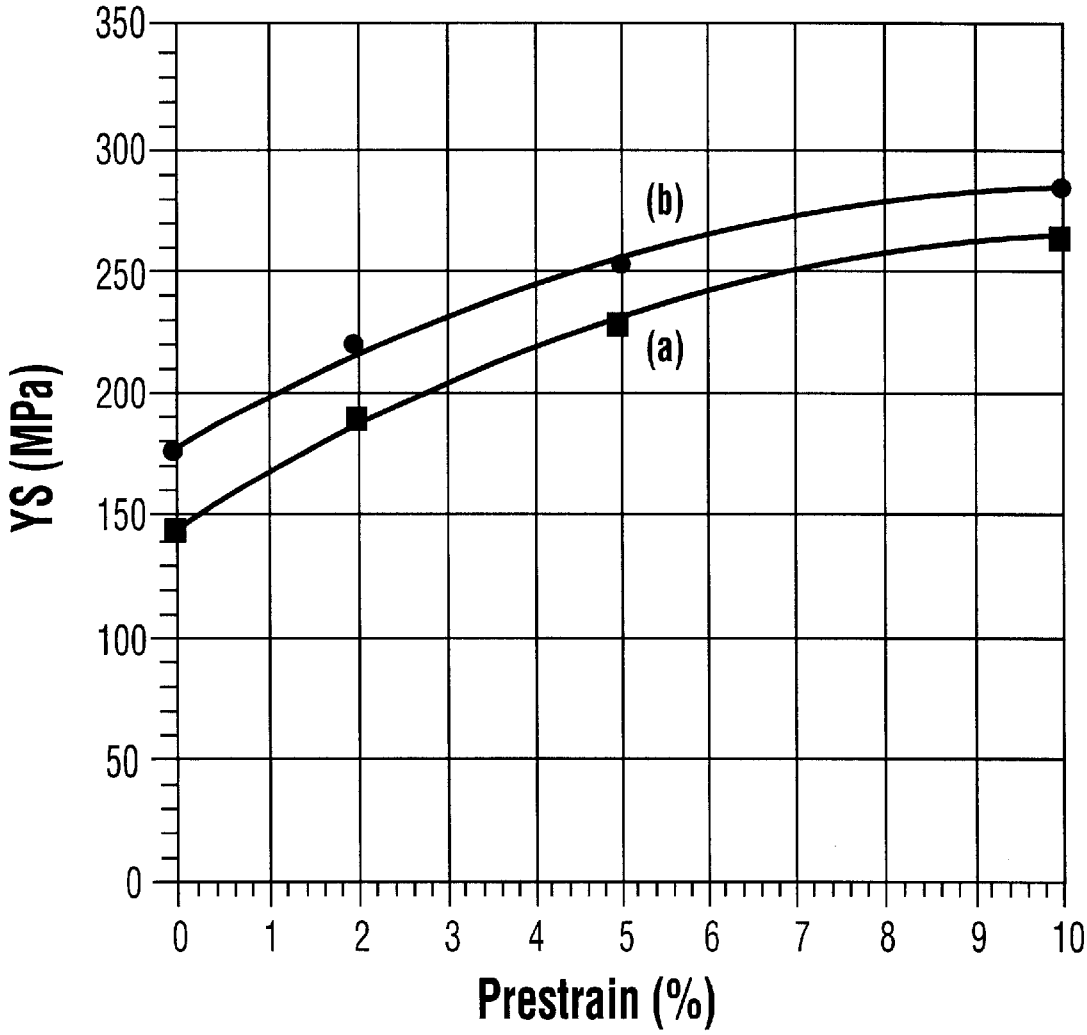
FIG. 2 ( PRIOR ART )
FIG. 2 is a graph as explained in the Examples below, showing the variation in yield strength (YS) of conventional AA6111-T4 with (a) prestrain; and (b) prestrain plus ½ hour at 177° C.
Figure 3:
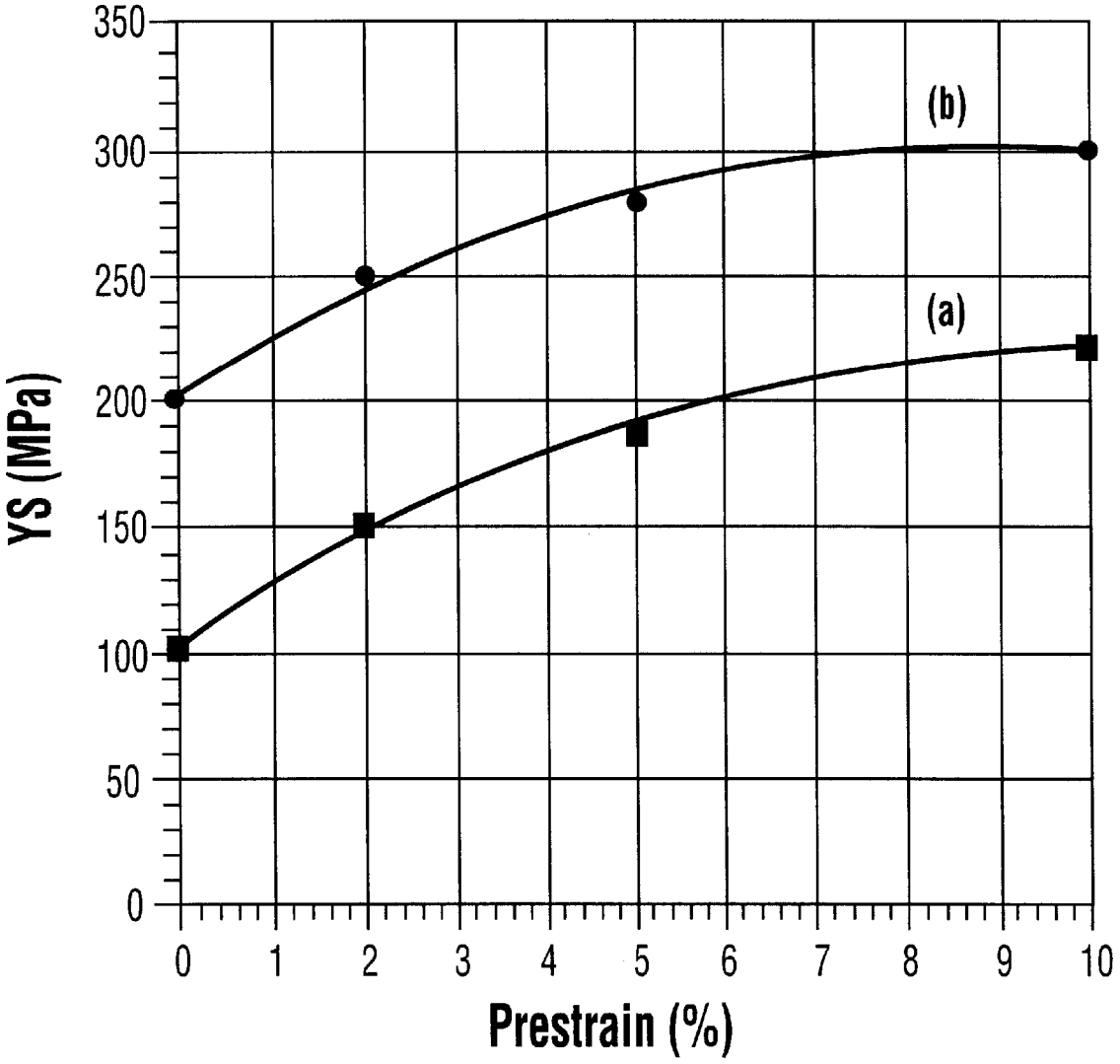
FIG. 3 is a graph as explained in the Examples below, showing the variation in yield strength (YS) of conventional AA6111, heat treated according to one form of the present invention, with (a) prestrain; and (b) prestrain plus ½ hour at 177° C.

The variation in yield strength (YS) of the pre-strained and artificially aged (½ hour at 177° C.) material for both conventional and the inventive process are plotted in FIGS. 2 and 3, respectively, of the accompanying drawings.

FIG. 2 shows that the paint bake response of the AA6111—T4 material increased about 30 MPa due to aging for 30 minutes at 177° C. (simulated paint cure). A similar response is observed in pre-strained material, although the net yield strength (YS) in the 5 and 10% pre-strained product is slightly lower due to recovery. The yield strength (YS) of the thermally spiked material decreases about 40 MPa for all levels of pre-strain, although the paint bake response is about 90 MPa, which is greater than their conventional counterparts (compare FIGS. 2 and 3). The 10% pre-strained material shows slightly less paint bake response, which is related to the loss of strength due to recovery. In general, it is clear from FIGS. 2 and 3 that the inventive process improves the paint bake response of the material, with and without prior pre-strain, quite considerably. This means that the process can be used to heat-treat the formed part according to the invention and enhanced paint cure strength could be achieved.

EXAMPLE 2

The tensile properties of the samples sheared from three different locations of a hood, formed from a T4P temper material, were determined in the as-received and artificially aged conditions. Table 2 lists the results of the tests carried out in variety of conditions.

TABLE 2

Yield Strength (MPa) of a Hood Outer at Different Locations Before and After Aging at Different Temperatures

| | As Formed Plus Aging | | | | | | |
|---|---|---|---|---|---|---|---|
| | None | 30 min @ 140° C. | | 30 min @ 150° C. | | 30 min @ 177° C. | |
| Location | Actual | Actual | Expected | Actual | Expected | Actual | Expected |
| | Samples Near Center Line Cut (Longitudinal) | | | | | | |
| Front | 219 | 231 | 252 | 236 | 263 | — | 297 |
| Middle | 218 | 230 | 248 | 236 | 262 | — | 296 |
| Rear | 219 | 230 | 249 | 236 | 263 | — | 296 |
| | Driver Side Middle (Transverse) | | | | | | |
| Front | 226 | — | — | — | — | 277 | 304 |
| Middle | — | — | — | — | — | 270 | 292 |
| Rear | — | — | — | — | — | 263 | 285 |

It can be seen that the ageing response of the hood material is about 20 MPa lower than expected from the laboratory simulation experiments in all aging conditions. Table 3 compares the properties of the hood material with those subjected to thermal spiking at 240° C. according to the inventive process.

TABLE 3

Mechanical Properties of a Hood Outer and the Effect of Thermal Spiking Driver Side (Transverse Direction)

| | As Formed | | | | | As Formed + ½ h @ 177° | | | As Formed + PMT @ 240° C. + ½ h @ 177° C. | | |
|---|---|---|---|---|---|---|---|---|---|---|---|
| Location | Thick mm | % Red[n] | YS MPa | UTS MPa | % El | YS MPa | UTS MPa | % El | YS MPa | UTS MPa | % El |
| Middle | 0.97 | 3.0 | 218 | 309 | 19 | 267 | 348 | 18 | 281 | 352 | 16 |

It is clear that the strength of the thermally spiked material after aging 30 for minutes at 177° C. is about 14 MPa higher than its conventional formed and aged counterpart.

What we claim is:

1. A process of producing a painted shaped article, comprising:

obtaining a sheet article made of an aluminum alloy of the 2000 or 6000 series in a T4 or T4P temper;

allowing the sheet article to age naturally for a period of 48 hours or more;

shaping the article by bending or stamping the article to form a non-planar shaped article:

subjecting the shaped article to a thermal spiking treatment involving heating the shaped article temporarily to a peak temperature in a range of 150 to 300° C.;

applying paint to the shaped article to form a painted shaped article; and optionally to further enhance hardness of the painted shaped article and/or to cure the applied paint, by baking the article at a temperature of at least about 177° C.

2. The process of claim 1, wherein said peak temperature is within the range of 150 to 225° C.

3. The process of claim 2, wherein said heating of the shaped article is carried out at a rate in the range of 1 to 70° C./minute.

4. The process of claim 2, wherein said painted shaped article is subjected to said baking at a temperature of at least 177° C. to further enhance said hardness.

5. The process of claim 1, wherein said peak temperature is within the range of 225 to 300° C.

6. The process of claim 5, wherein said heating of said shaped article is carried out at a rate in the range of 10 to 280° C./minute.

7. The process of claim 5, wherein said heating of said shaped article is carried out at a rate in the range of 210 to 285° C./minute.

8. The process of claim 5, wherein said baking at said temperature of at least about 177° C. is omitted.

9. The process of claim 1, wherein said shaped article is allowed to cool immediately after it reaches said peak temperature during said thermal spiking treatment.

10. The process of claim 1, wherein said shaped article is maintained at said peak temperature for a period of time during said thermal spiking treatment before being allowed to cool.

11. The process of claim 10, wherein said period of time is up to about 5 minutes.

12. The process of claim 1, wherein said thermal spiking treatment is carried out in a continuous heat treatment furnace.

13. The process of claim 7, wherein said thermal spiking treatment is carried out as part of a continuous shaping and painting process.

* * * * *